US007441533B1

(12) United States Patent
Miller et al.

(10) Patent No.: US 7,441,533 B1
(45) Date of Patent: Oct. 28, 2008

(54) COVER ASSEMBLY FOR AN INTERNAL COMBUSTION ENGINE

(75) Inventors: Alan S. Miller, Farmington Hills, MI (US); Claude W Bailey, III, Warren, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 2 days.

(21) Appl. No.: 11/745,147

(22) Filed: May 7, 2007

(51) Int. Cl.
*F01M 9/10* (2006.01)
*F02B 77/04* (2006.01)

(52) U.S. Cl. ..... 123/198 E; 123/90.38; 181/205

(58) Field of Classification Search ..... 123/198 E, 123/90.38; 181/205
See application file for complete search history.

(56) References Cited

U.S. PATENT DOCUMENTS 5,513,603 A * 5/1996 Ang et al. ..... 123/198 E

* cited by examiner

*Primary Examiner*—Noah Kamen

(57) ABSTRACT

A cover assembly is provided, such as a camshaft cover or valve cover, for an internal combustion engine. The cover assembly includes a cover member with a contoured surface. An acoustic barrier member is generally coextensive with the cover member and at least partially approximates the contoured surface. An elastic member is mounted with respect to the acoustic barrier member and spans at least a portion of the acoustic barrier member. A plate member is mounted with respect to the elastic member and is operable to retain the elastic member and the acoustic barrier member with respect to the cover member. The plate member spans substantially the entirety of the elastic member.

17 Claims, 3 Drawing Sheets

COVER ASSEMBLY FOR AN INTERNAL COMBUSTION ENGINE

TECHNICAL FIELD

The present invention relates to a cover assembly for an internal combustion engine.

BACKGROUND OF THE INVENTION

An internal combustion engine typically includes a valvetrain having components such as a camshaft, rocker arms, valve springs, valves, etc. During operation of the internal combustion engine, the components of the valvetrain cooperate to induct air into, and exhaust products of combustion from the internal combustion engine. A cover is typically mounted to a cylinder head of the internal combustion engine and operates to substantially enclose the valvetrain of the engine.

SUMMARY OF THE INVENTION

A cover assembly, such as a camshaft cover or valve cover for an internal combustion engine is provided. The cover assembly includes a cover member having a contoured surface and a flange portion. The flange portion is configured for attachment to the internal combustion engine. An acoustic barrier member is generally coextensive with the cover member and at least partially approximates the contoured surface. An elastic member is mounted with respect to the acoustic barrier member and spans at least a portion of the acoustic barrier member. A plate member is mounted with respect to the elastic member and is operable to retain the elastic member and the acoustic barrier member with respect to the cover member. The plate member spans substantially the entirety of the elastic member. At least one post is formed on the cover member and extends through at least one hole defined by the acoustic barrier member and at least one hole defined by the elastic member. The plate member defines a fastening feature operable to engage the at least one post to retain the elastic member and the acoustic barrier with respect to the cover member.

The fastening feature may include a plurality of radially inwardly projecting fingers operable to engage the at least one post. Additionally, at least one of the plurality of radially inwardly projecting fingers may be operable to deform at least a portion of the at least one post thereby retaining the plate member with respect to the cover member.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
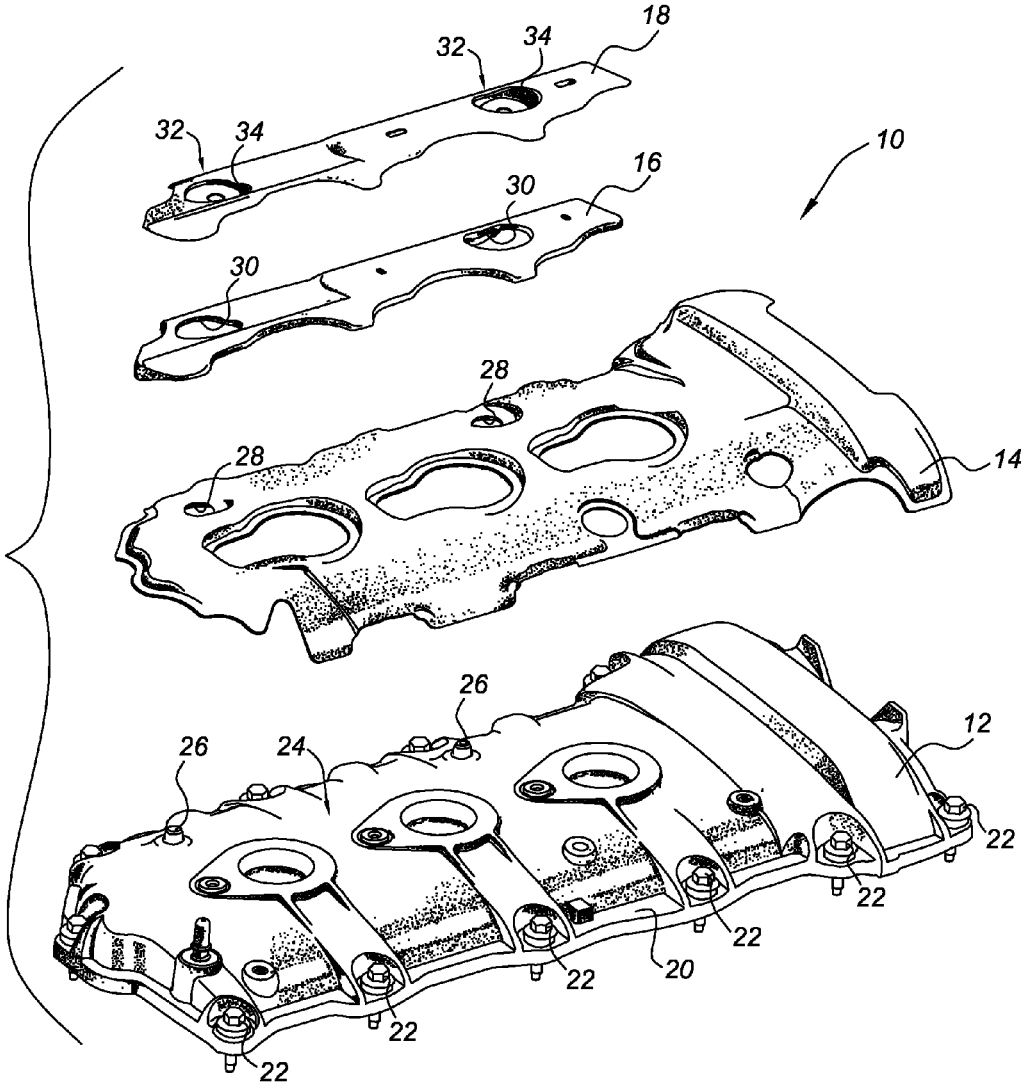
FIG. 1 is an exploded perspective view of a cover assembly for an internal combustion engine.

Referring to the drawings wherein like reference numbers correspond to like or similar components throughout the several figures there is shown in FIG. 1 a cover assembly, generally indicated at 10. The cover assembly 10 in the preferred embodiment is a camshaft cover or valve cover for an internal combustion engine, not shown. The cover assembly 10 includes a cover member 12, acoustic barrier member 14, elastic member 16, and plate member 18.

The cover member 12, in a preferred embodiment, is formed from a composite material, such as glass filled polymer. The cover member 12 includes a flange portion 20 configured to receive a plurality of fasteners 22. The plurality of fasteners 22 is operable to removably mount the cover member 12 with respect to a cylinder head, not shown, of the internal combustion engine. The cover member 12 has a generally contoured surface, generally indicated at 24. A plurality of posts 26 are formed integrally with the cover member 12. The posts 26 are generally cylindrical in shape and extend from the contoured surface 24.

The acoustic barrier member 14 is mounted with respect to the cover member 12 and is preferably formed from a composite material, such as glass filled polymer. The acoustic barrier member 14 spans substantially the entirety of the cover member 12 and generally matches or approximates the generally contoured surface 24 of the cover member 12. The acoustic barrier member 14 defines holes 28 sufficiently configured to receive posts 26 therethrough.

The elastic member 16 is formed from a rubber or other material possessing elastic properties. The elastic member 16 is mounted with respect to the acoustic barrier member 14 and spans at least a portion of the acoustic barrier member 14. The elastic member 16 defines holes 30 configured to receive posts 26 therethrough.

The plate member 18 is preferably stamped from sheet metal, such as steel, stainless steel, aluminum, etc. The plate member 18 spans substantially the entirety of the elastic member 16 and is operable to retain the elastic member 18 and the acoustic barrier member 16 with respect to the cover member 12. As illustrated in FIG. 1, the plate member 18 generally approximates the shape of the elastic member 16. The plate member 18 has fastening features 32 formed integrally therewith. The fastening features 32 are formed within recessed portions 34 of the plate member 18. The recessed portions 34 are configured to extend through the holes 30 defined by the elastic member 16.

Figure 2:
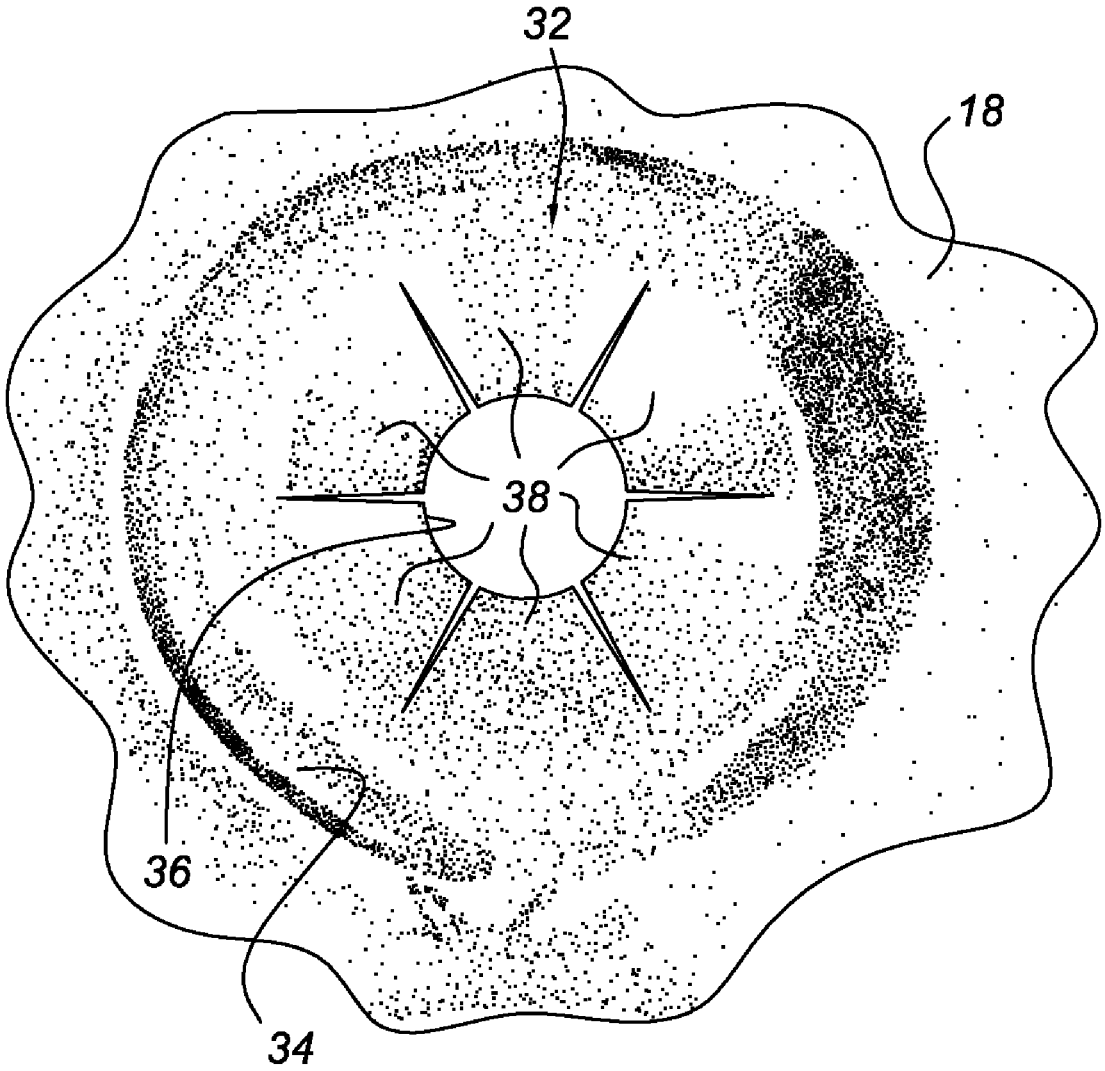
FIG. 2 is a plan view of a fastening feature formed on a plate member of the cover assembly of FIG. 1.
Figure 3:
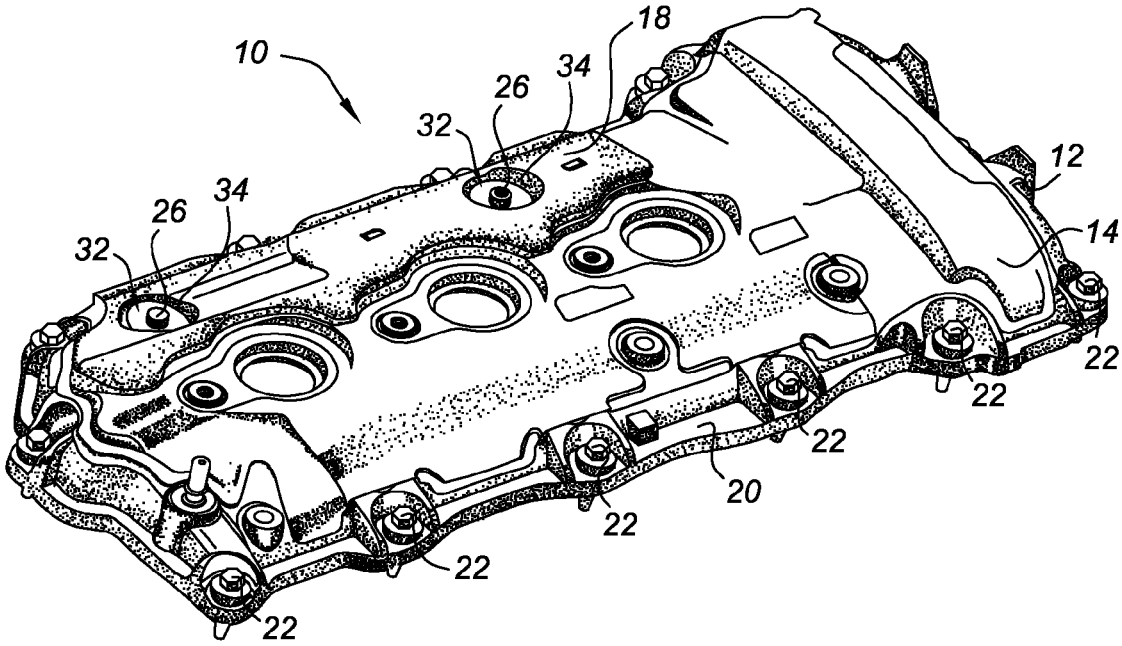
FIG. 3 is a perspective view of the cover assembly of FIG. 1 in the assembled state.

Referring to FIG. 2, there is shown a plan view of one of the fastening features 32. The fastening feature 32 includes a plurality of generally radially inwardly projecting fingers 38 which cooperate to define a generally circular hole 36. The fastening feature 32 of FIG. 2 illustrates six fingers 38; however, those skilled in the art will recognize that more or fewer fingers 38 may be employed while remaining within the scope of that which is claimed. The fastening feature 32 is preferably formed during the manufacturing of the plate member 18 by a coining operation. The hole 36 is sufficiently undersized to receive one of the plurality of posts 26 such that the fingers 38 are biased into engagement against the post 26. In the preferred embodiment, the fingers 38 will deform a portion of the post 26 thereby irremovably retaining the plate member 18, and therefore the elastic member 16 and acoustic barrier member 14, with respect to the cover member 12. Referring now to FIG. 3, there is shown the cover assembly 10 in the assembled state.

In operation, the cover member 12 may be subject to vibrations resulting in the emission of noise. The acoustic barrier member 14 and the elastic member 16 cooperate to damp these vibrations, thereby reducing or eliminating noise emissions from the cover assembly 10. Although the discussion hereinabove has focused on a valve cover or cam cover, the cover assembly 10 may be adapted to enclose other portions of the internal combustion engine such as, for example, a timing drive assembly while remaining within the scope of that which is claimed.

While the best modes for carrying out the invention have been described in detail, those familiar with the art to which this invention relates will recognize various alternative designs and embodiments for practicing the invention within the scope of the appended claims.

What is claimed is:

1. A cover assembly for an internal combustion engine, the cover assembly comprising:

a cover member having a contoured surface;

an acoustic barrier member generally coextensive with said cover member and at least partially approximating said contoured surface;

an elastic member operatively mounted to said acoustic barrier member and spanning at least a portion of said acoustic barrier member;

a plate member operatively mounted to said elastic member and operable to retain said elastic member and said acoustic barrier member with respect to said cover member; and wherein said plate member spans substantially the entirety of said elastic member.

2. The cover assembly of claim 1, further comprising:

at least one post formed on said cover member;

wherein said at least one post extends through at least one hole defined by said acoustic barrier member and at least one hole defined by said elastic member; and wherein said plate member defines a fastening feature operable to engage said at least one post to retain said elastic member and said acoustic barrier with respect to said cover member.

3. The cover assembly of claim 2, wherein said fastening feature includes a plurality of radially inwardly projecting fingers operable to engage said at least one post.

4. The cover assembly of claim 3, wherein at least one of said plurality of radially inwardly projecting fingers is operable to deform at least a portion of said at least one post thereby retaining said plate member with respect to said cover member.

5. The cover assembly of claim 1, wherein said plate member is formed from metal.

6. The cover assembly of claim 1, wherein at least one of said cover member and said acoustic barrier member is formed from a composite material.

7. The cover assembly of claim 1, wherein said elastic member is formed from rubber.

8. The cover assembly of claim 1, wherein said cover member is a camshaft cover.

9. A cover assembly for an internal combustion engine, the cover assembly comprising:

a cover member;

an acoustic barrier member spanning substantially the entirety of said cover member;

an elastic member mounted with respect to said acoustic barrier member and spanning at least a portion of said acoustic barrier member;

a plate member mounted with respect to said elastic member and operable to retain said elastic member and said acoustic barrier member with respect to said cover member;

wherein said plate member spans substantially the entirety of said elastic member;

at least one post formed on said cover member;

wherein said at least one post extends through at least one hole defined by said acoustic barrier member and at least one hole defined by said elastic member; and wherein said plate member defines a fastening feature operable to engage said at least one post to retain said elastic member and said acoustic barrier with respect to said cover member.

10. The cover assembly of claim 9, wherein said fastening feature includes a plurality of radially inwardly projecting fingers operable to engage said at least one post.

11. The cover assembly of claim 9, wherein said cover member has a generally contoured surface and wherein said acoustic barrier member at least partially approximates said contoured surface.

12. A camshaft cover for an internal combustion engine, the camshaft cover comprising:

a cover member having a contoured surface and a flange portion;

wherein said flange portion is configured for attachment to the internal combustion engine;

an acoustic barrier member generally coextensive with said cover member and at least partially approximating said contoured surface;

an elastic member mounted with respect to said acoustic barrier member and spanning at least a portion of said acoustic barrier member;

a plate member mounted with respect to said elastic member and operable to retain said elastic member and said acoustic barrier member with respect to said cover member;

wherein said plate member spans substantially the entirety of said elastic member;

at least one post formed on said cover member;

wherein said at least one post extends through at least one hole defined by said acoustic barrier member and at least one hole defined by said elastic member; and wherein said plate member defines a fastening feature operable to engage said at least one post to retain said elastic member and said acoustic barrier with respect to said cover member.

13. The camshaft cover assembly of claim 12, wherein said fastening feature includes a plurality of radially inwardly projecting fingers operable to engage said at least one post.

14. The camshaft cover assembly of claim 13, wherein at least one of said plurality of radially inwardly projecting fingers is operable to deform at least a portion of said at least one post thereby retaining said plate member with respect to said cover member.

15. The camshaft cover assembly of claim 12, wherein said plate member is formed from metal.

16. The camshaft cover assembly of claim 12, wherein said elastic member is formed from rubber.

17. The camshaft cover assembly of claim 12, wherein at least one of said cover member and said acoustic barrier member is formed from a composite material.

* * * * *